US007815531B1

(12) United States Patent
Gait

(10) Patent No.: US 7,815,531 B1
(45) Date of Patent: Oct. 19, 2010

(54) STRINGING CHANNELS FOR A LACROSSE HEAD

(75) Inventor: Paul Gait, Altamont, NY (US)

(73) Assignee: Rawlings Sporting Goods Company, Inc., St. Louis, MO (US)

( * ) Notice: Subject to any disclaimer, the term of this patent is extended or adjusted under 35 U.S.C. 154(b) by 22 days.

(21) Appl. No.: 12/129,628

(22) Filed: May 29, 2008

Related U.S. Application Data

(60) Provisional application No. 60/940,675, filed on May 29, 2007.

(51) Int. Cl.
*A63B 59/02* (2006.01)
*A63B 65/12* (2006.01)

(52) U.S. Cl. ..... 473/513; D21/724

(58) Field of Classification Search ..... 473/513, 473/512, 505; D21/724
See application file for complete search history.

(56) References Cited

U.S. PATENT DOCUMENTS

| | | | | |
|---|---|---|---|---|
| 4,097,046 | A * | 6/1978 | Friant | 473/513 |
| 5,568,925 | A | 10/1996 | Morrow et al. | |
| 5,651,549 | A | 7/1997 | Dill et al. | |
| 6,066,056 | A * | 5/2000 | Morrow | 473/513 |
| 6,561,932 | B2 | 5/2003 | Morrow et al. | |

* cited by examiner

*Primary Examiner*—Gene Kim
*Assistant Examiner*—M Chambers
(74) *Attorney, Agent, or Firm*—Waddey & Patterson, P.C.; Phillip E. Walker

(57) ABSTRACT

A lacrosse head having stringing channels useful for improving a strung lacrosse head is disclosed.

15 Claims, 14 Drawing Sheets

STRINGING CHANNELS FOR A LACROSSE HEAD

This Utility Patent Application claims benefit of previously filed provisional patent application No. 60/940,675 filed May 29, 2007 entitled Stringing Channels for a Lacrosse Head.

This is a Nonprovisional Patent Application filed for the invention by Paul Gait, 5 Normandy Dr., Altamont, N.Y. 12009, a citizen of Canada, entitled "Stringing Channels for a Lacrosse Head."

All patents and publications described or discussed herein are hereby incorporated by reference in their entirety.

BACKGROUND OF THE INVENTION

1. Technical Field

The present invention relates to the lacrosse head having the improvement of channels for the strings of the pocket within the lacrosse head. More particularly, the present invention relates to channels being molded into the lacrosse head which allows for greater durability and less abrasion to the lacrosse pocket held within the lacrosse head. The invention also includes multiple embodiments of which provide different features and advantages over lacrosse heads not having the inventive channels.

2. Background of the Art

The lacrosse game originated with the American and Canadian-Native Americans. Traditionally, a lacrosse stick has a handle portion attached to a head with the head consisting generally of a frame and a pocket. It will be appreciated by those of ordinary skill in the art that a well constructed lacrosse head is essential in both the general play by and especially the success of participants of the sport of lacrosse.

Generally, a lacrosse head can be described as a basket that attaches to the end of the handle that is used to catch, transport, and deliver the ball as desired. The lacrosse head not only catches the ball and holds the ball during play, but is also used during defensive maneuvers and to obtain the ball during a face off. As such, the lacrosse head is subjected to both large and varying forces during the game. As such, lacrosse heads are typically formed of some type of plastic material which is rigid though can deform so as not to crack or break under the typical stresses experienced during participation in a lacrosse game.

Generally, a lacrosse head is molded from a polymeric material such as DuPont® Xytel brand nylon. The lacrosse head has an open or upper side for catching and discharging the ball and a lower side to which a net or pocket is attached for holding a ball. A lacrosse head has a throat section having a socket for receiving the handle and a ball stop. To the ball stop, there is attached a pair of side walls. The side walls are joined distal from the ball stop by a lip or scoop. Traditionally, the side walls are substantially vertical and flat. As in the game of lacrosse, the head is used to catch the ball, hold the ball, pass or shoot the ball, there are several attempts to improve lacrosse heads so as to improve performance and characteristics of the given lacrosse stick. U.S. Pat. No. 5,568,925 discloses a shoulder portion below the ball stop that it creates an angular recess or step. This shoulder retains the ball, however, some individuals believe the shoulder holds the ball too well and impedes the ball from rolling out of the head. Furthermore, the shoulder prevents the ball from rolling consistently along the side wall from the top to the bottom or from the bottom to the top of the lacrosse head.

Other lacrosse heads have been invented wherein the lacrosse head is narrower at the opening than at the pocket area such as the lacrosse head disclosed in U.S. Pat. No. 5,651,549. Other players desire a lacrosse head where the open side of the lacrosse head is larger than the net side of lacrosse head such as lacrosse head disclosed in U.S. Pat. Nos. 6,066,056 and 6,561,932. While these patents disclose different wall arrangements, shoulders, and other orientation of the stick, they do little to discuss the attachment of the pocket within the lacrosse head to the lacrosse head itself. As such, these different patents appear to fail to address the issues of the pocket engaged in lacrosse head and the problematic issues of the ball transferring from the frame of the lacrosse head to the pocket and also the considerable wear placed upon the lacrosse pocket during both game play and practice.

As the ball is constantly being scooped up off of artificial turf or other substances, as well as being caught and launched by the player, the contact area between the strings of the lacrosse pocket and the lacrosse frame undergo substantial stress. Unfortunately, with extended game play in practice, as well as varying environmental conditions that the lacrosse head pocket is exposed to, the strings will often break typically from excessive wear at the string scoop interface, thus requiring the pocket to be replaced. This is both a time consuming and labor intensive endeavor often keeping the lacrosse head out of play for a considerable amount of time.

Accordingly, there is a need for stringing channels integrated into a lacrosse head that both improve ball handling characteristics and also lengthen the life of the pocket stringing while still providing the performance characteristics demanded by lacrosse players.

What is desired, therefore, are stringing channels which may be integrated into a lacrosse head so as to improve the scoop and lacrosse pocket interface as well as increase the life span of the stringing of a lacrosse pocket. Indeed, a combination of characteristics including stringing channels to decrease the wear on the lacrosse pocket have been found to be necessary in improving the lifespan and playing characteristics of a pocket in a lacrosse head. Also desired are various embodiments of string channels for the various styles of pockets head within lacrosse heads.

BRIEF SUMMARY OF THE INVENTION

The present invention provides a string channel for a lacrosse head which is uniquely capable of providing for improved ground ball pickup and reduced lace wear by integration into a lacrosse head.

More particularly, the inventive string channel for a lacrosse head include at least one recess integrated into the lacrosse head so that the string or other element of the pocket is more recessed into the lacrosse head. The channel may be integrated during the initial molding of the lacrosse and can embody a variety of different forms providing for the variety of different stringing patterns used typically for stringing a lacrosse head. Furthermore, the string channels may also provide recesses for the larger runners running from the scoop to the throat of the lacrosse head to additionally allow for reduced wear on the runners and also improve ground ball pickup.

The inventive string channels for lacrosse head can provide recesses for a mesh pocket and also a traditional pocket as well as a hybrid pocket with channels typically but not limited to being designed into the scoop area of the lacrosse stick. In addition, the string channels may be on the front side where the ball is caught and also on the back side of the scoop of the lacrosse head to provide advantageously for lesser wear of the strings at the scoop, and furthermore, to better improve ground ball pickup. Advantageously to utilize the string channels for a lacrosse head, the lacrosse head is strung with a string feeding through the channels so that the portion of the string at the pocket scoop interface is recessed at least partially within the frame portion of the lacrosse head.

An object of the invention, therefore, is a lacrosse frame having string channels which enable it to be better employed for ground ball pickup.

Another object of the invention are string channels integrated into lacrosse head with the string or runners at the pocket scoop interface being at least partially recessed within the scoop of the stick.

Another object of the invention are string channels integrated into lacrosse head with the channels existing on both the front side and back side of the scoop of a lacrosse head.

Still another object of the invention are string channels providing recesses for both runners and lace of the lacrosse pocket of the lacrosse head.

These aspects and others that will become apparent to the artisan upon review of the following description can be accomplished by providing at least one string channel into a lacrosse head and stringing a lacrosse head wherein ground ball pickup will be improved as well as the durability of the lacrosse pocket at the scoop lacrosse pocket interface.

DETAILED DESCRIPTION OF THE PREFERRED EMBODIMENTS

Figure 1:
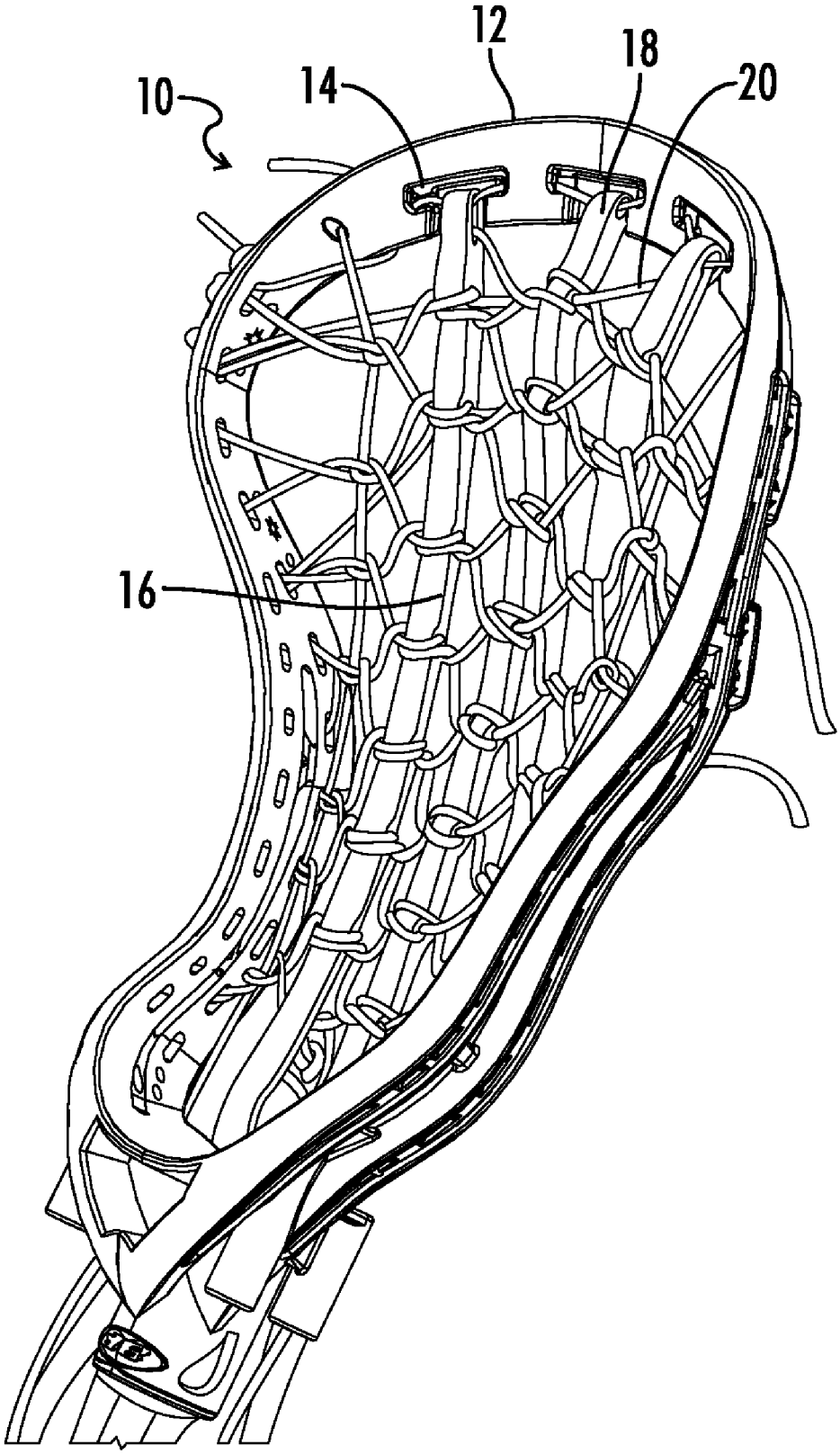
FIG. 1 is a view of an embodiment of a strung head having the inventive string channels.

Referring generally now to FIGS. 1-8*c*, a lacrosse head is shown and generally designated by the numeral 10. Lacrosse head 10 is for use in conjunction with lacrosse stick typically in the game play of lacrosse. Lacrosse head 10 has scoop 12 which is considered the upper most part of the lacrosse head and is utilized in both throwing and scooping the ball off the ground. Within scoop 12 is a stringing channel 14 of the present invention which provides for an improved ground ball pickup and reduced lace and string wear of a lacrosse stick. The pocket of lacrosse head 10 is shown and generally designated by the numeral 16 and can include runners 18 and lace 20 to comprise the pocket. Generally, laces 18 run vertically from scoop 12 to the throat of lacrosse head 10 with string 20 running throughout lacrosse pocket 16 and optionally being utilized to attach runners 18 to scoop 12 of lacrosse head 10.

As illustrated in FIG. 1, stringing channel 14 provide space for the recessing of runners 18 at three distinct points on scoop 12 of lacrosse head 10, though may include lesser or more recesses on further embodiments. Furthermore, laces 20 may run through recesses of stringing channel 14 and string through runners 18 to secure the runners within stringing channel 14 of scoop 12 of lacrosse head 10. As such, both lace 20 and runners 18 may be at least partially held within the recesses of stringing channel 14 of the present invention. With this arrangement, retrieving ground balls may be easier as the runners are at least partially recessed and furthermore the recessing provides for greater protection of runners 18 and lace 20 as they are at least partially protected within scoop 12 of lacrosse head 10.

Figure 2:
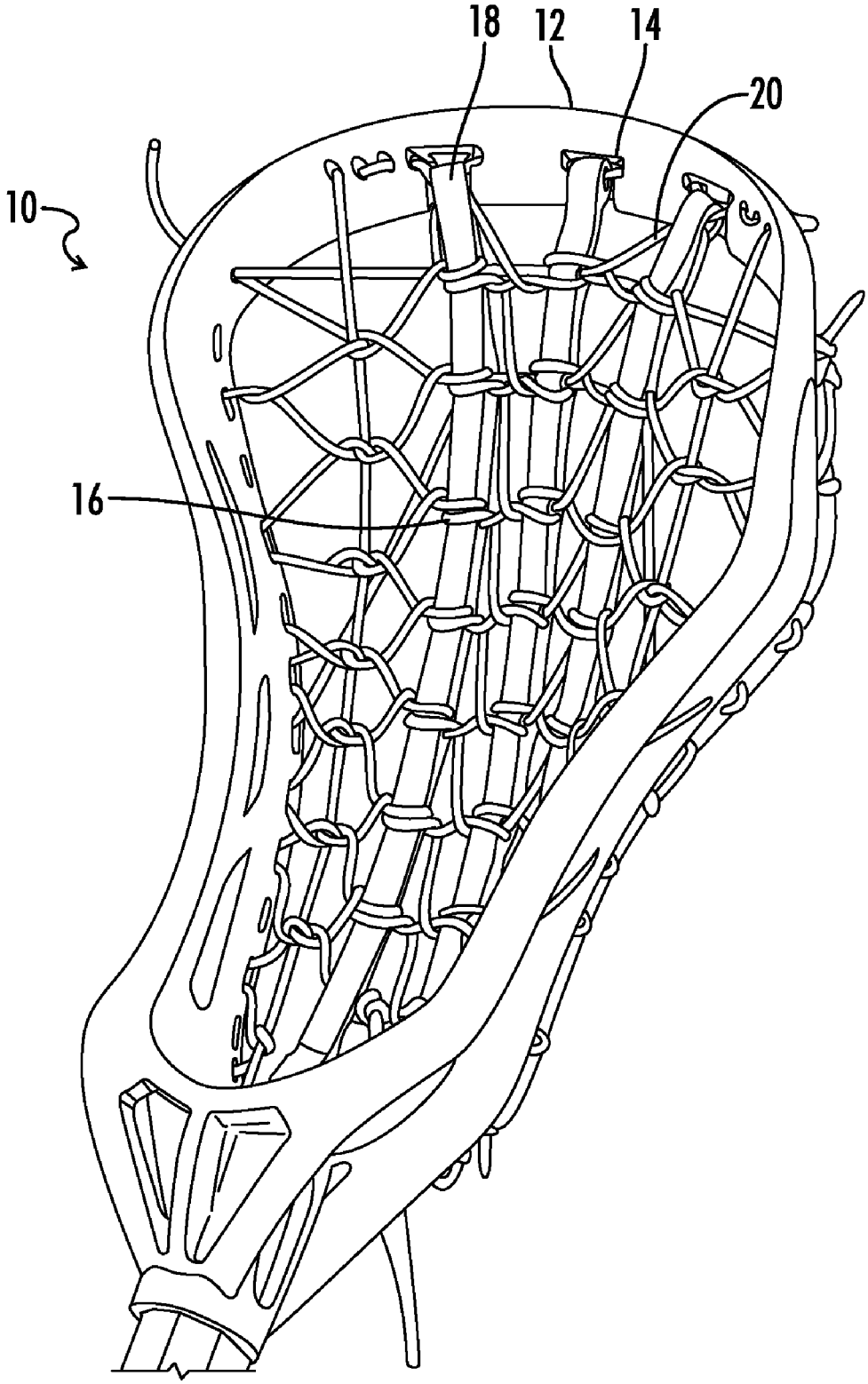
FIG. 2 is an illustration of an embodiment of a strung head having the inventive string channels.

FIG. 2 is a further embodiment of lacrosse head 10 having stringing channel 14 with a slightly different arrangement for the lace running therethrough scoop 12 of lacrosse head 10. This embodiment may provides for three runners, however, the invention of string channels is not limited to three runners and can include either greater or fewer runners in the design and additional runners may even be utilized with the above embodiment.

Figure 3:
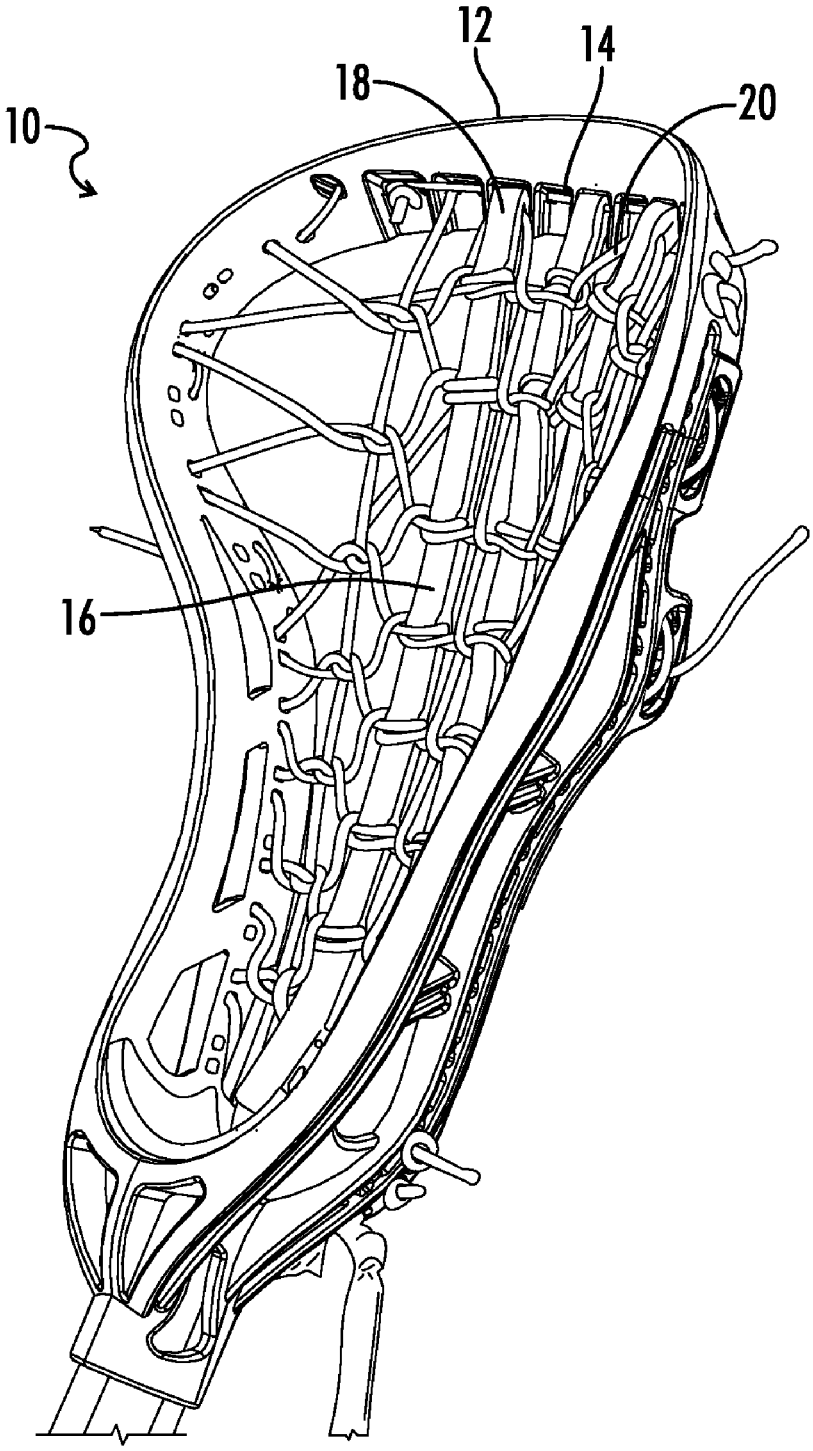
FIG. 3 is an illustration of an embodiment of a strung head having the inventive string channels.
Figure 4:
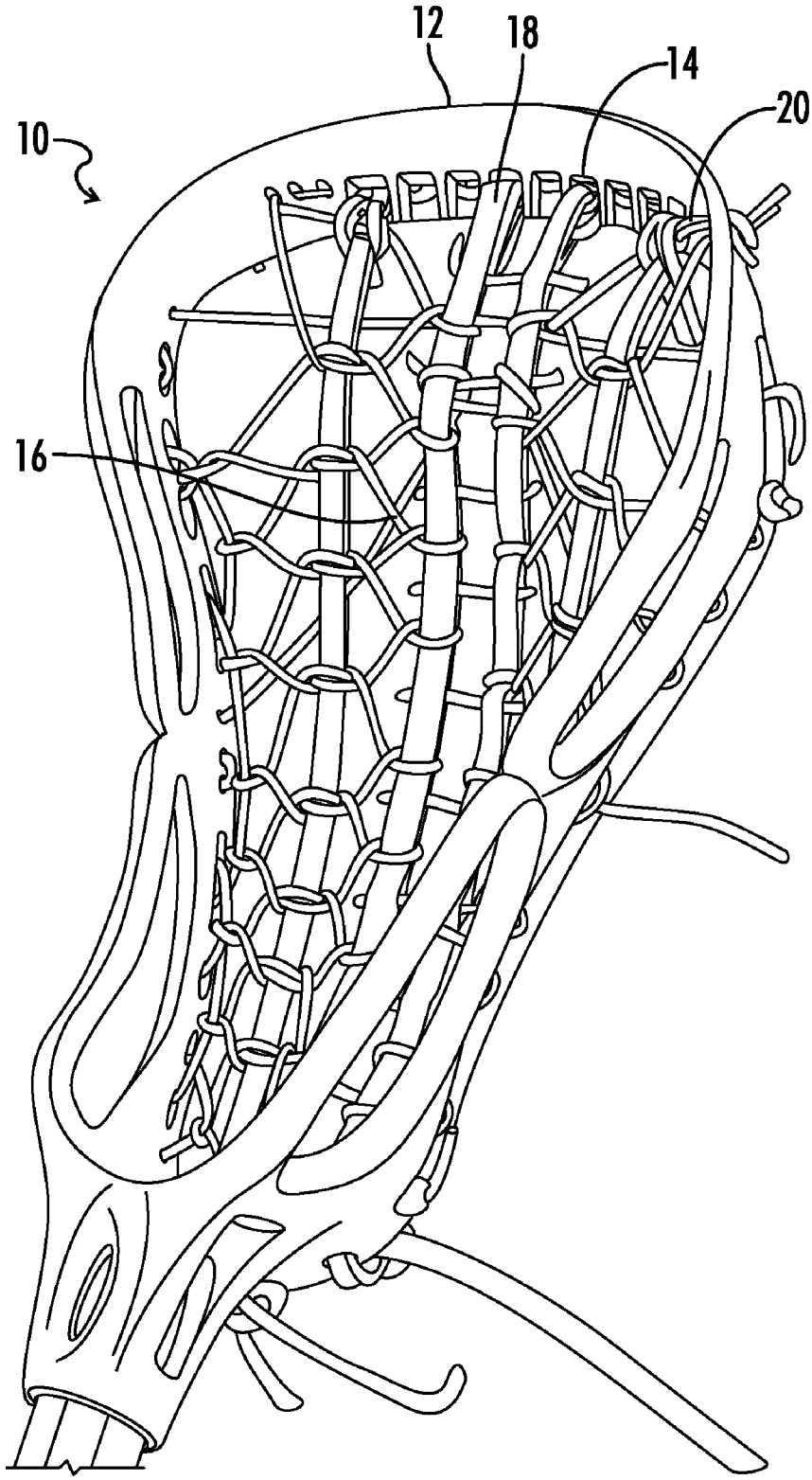
FIG. 4 is an illustration of an embodiment of a strung head having the inventive string channels.
Figure 5:
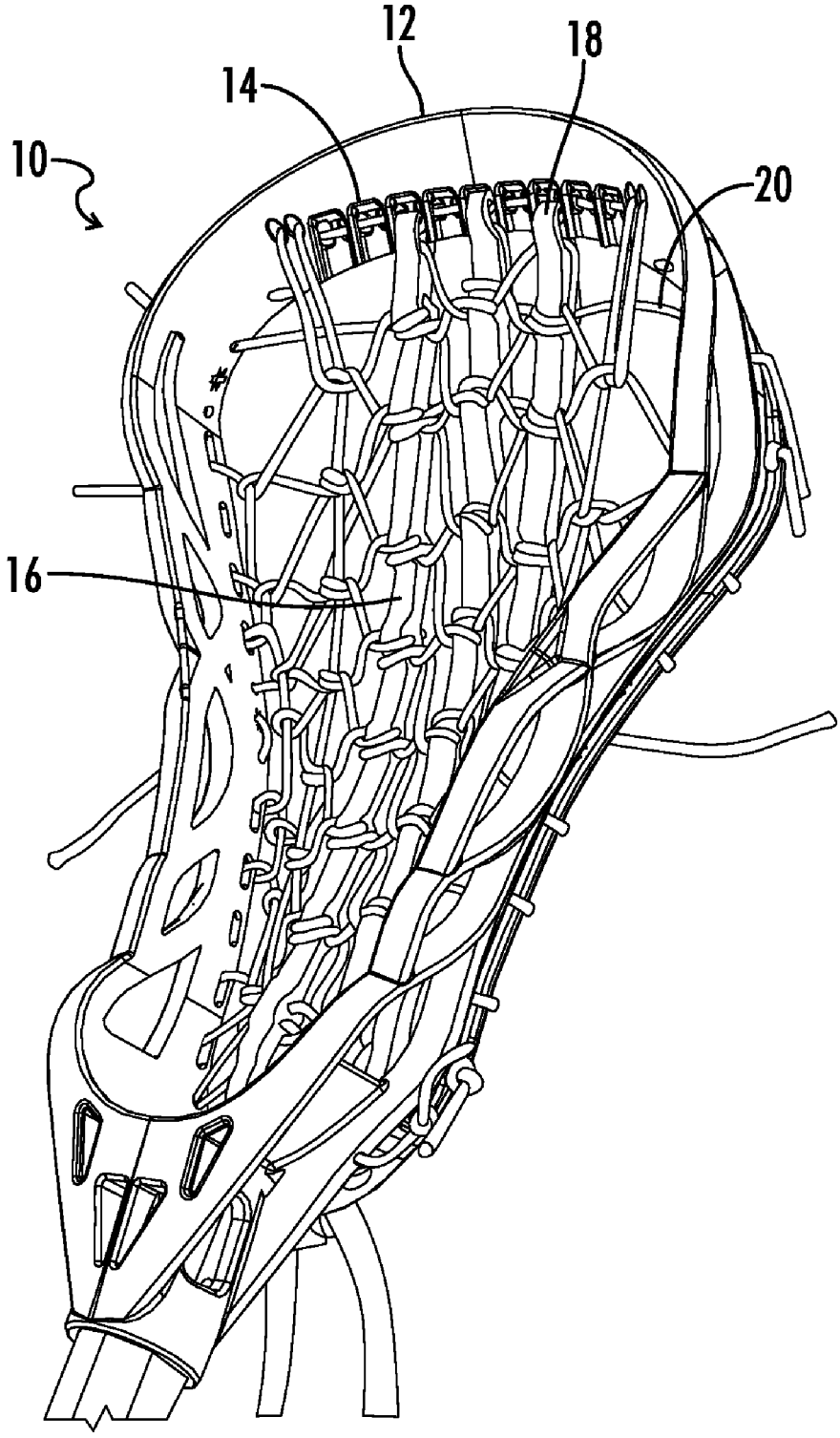
FIG. 5 is an illustration of an embodiment of a strung head having the inventive string channels.

FIG. 3 is an additional embodiment of stringing channel 14 wherein an additional amount of individual string channels 14 are provided for the option of creating various pockets 16 within lacrosse head 10. As such, scoop 12 of lacrosse head 10 as embodied in FIG. 3 may provide a great number of options for stringing wherein multiple runners may be utilized as well as lace may be run in a variety of different arrangements. Additionally, both FIG. 4 and FIG. 5 may provide similar but slightly different stringing channel arrangements so that the player has the option of providing a variety of pockets 16 within lacrosse head 10 having the inventive stringing channel 14.

Figure 6A:
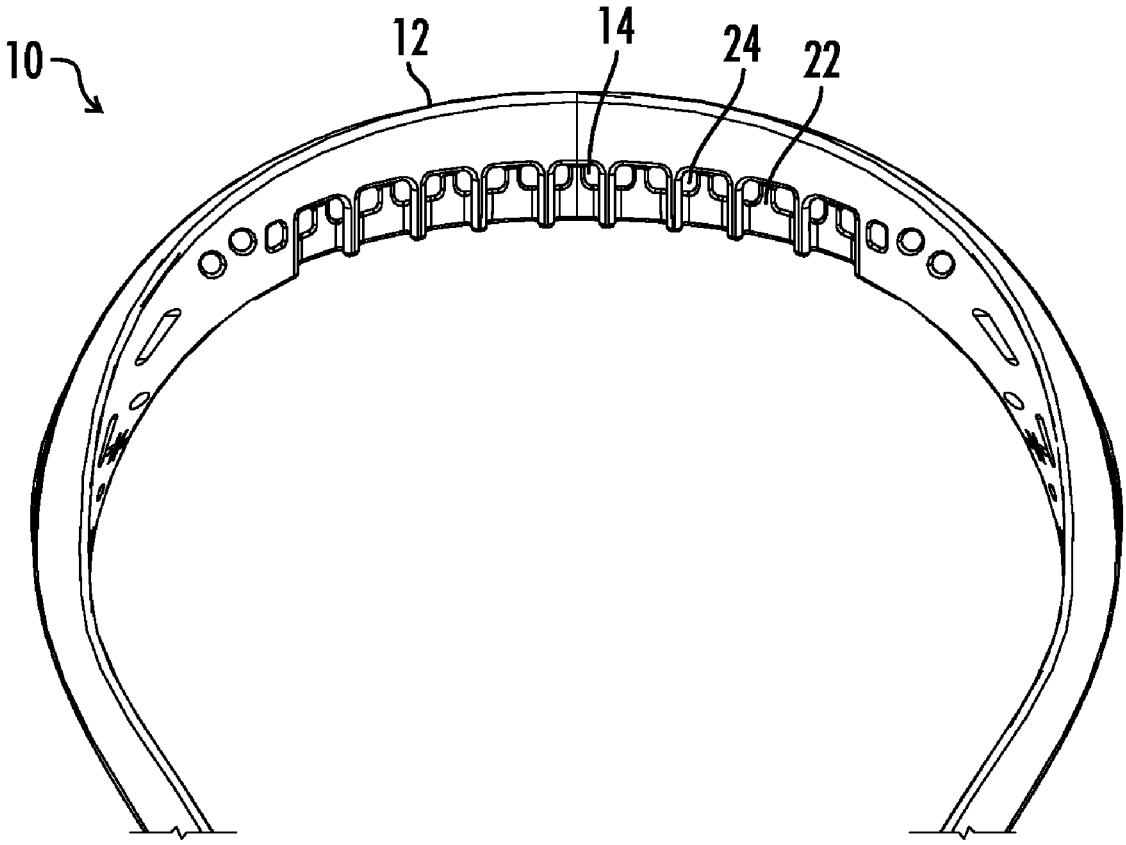
FIG. 6*a* is a front view of an embodiment of the string channels of an unstrung lacrosse head.

FIG. 6*a* is an illustration of a close-up view of an unstrung head having stringing channel 14 integrated in scoop 12 of lacrosse head 10. In this embodiment, multiple recesses 22 are present providing for the use of a variety of different runners in multiple arrangements. Furthermore, stringing channel 14 may also provide lace holes 24 for the weaving of lace throughout stringing channel 14 to firmly attach runners within recesses 22 of stringing channel 14. As such, both the laces and runners may be recessed at least partially within string channels 14 of lacrosse head 10. Furthermore, by use of this design with lace holes 24 and recesses 22, an individual may quickly string the runners and lace of a lacrosse to scoop 12 of lacrosse head 10 much quicker than the prior art as substantially all that is desired is running lace through lace holes 22 and also through runners situated in the desired recesses 24 for the style of pocket desired within lacrosse head 10.

Figure 6B:
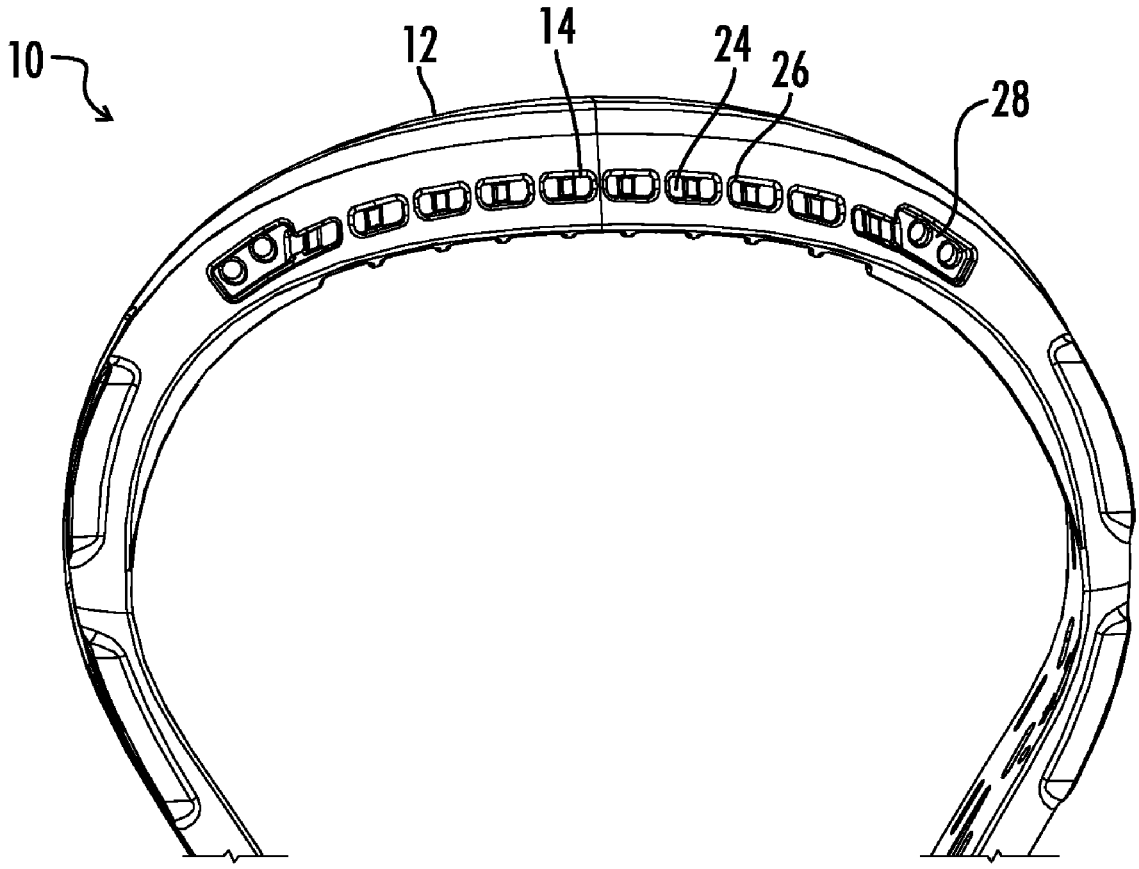
FIG. 6*b* is a rear view of an embodiment of the string channels of an unstrung lacrosse head.

FIG. 6*b* is the rear view of the embodiment of stringing channel 14 as illustrated in 6*a*. As is illustrated here, lace may be run through lace holes 24 and not be subject to the abrasions typical on the rear of lacrosse scoop 12 as the laces are recessed within stringing channel 14 of lacrosse head 10. More specifically, laces run in and out of lace openings 24 behind scoop element 26 so that the outer surface of scoop 12 includes little to no exposed lace which can be abraded during ground ball pickup or other elements of a lacrosse game.

Furthermore, lacrosse head 10 also includes recessed areas 28 for either knotting off or feeding the lace through in a variety of arrangements to achieve the desired pocket figuration for lacrosse head 10.

Figure 6C:
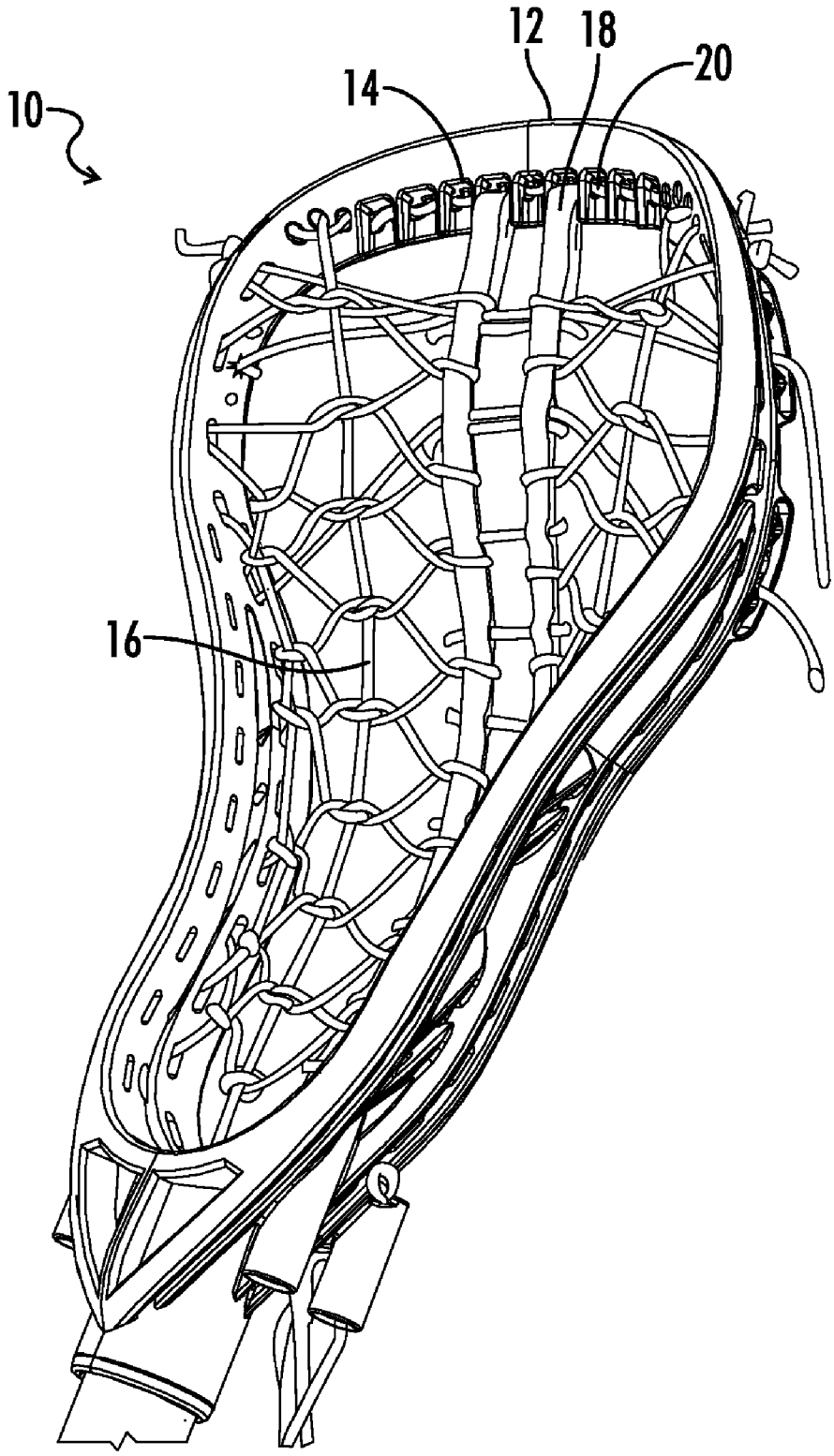
FIG. 6*c* is an illustration of an embodiment of the string channels in a strung lacrosse head.

FIG. 6*c* is the strung embodiment as illustrated previously in an unstrung fashion in 6*a* and 6*b*. More specifically, FIG. 6*c* illustrates how the string channels provide for the recessing of both lace 20 and at least the partial recessing of runners 18 of pocket 16 within lacrosse head 10. As such, the stringing channel 14 provide for improved ground ball pickup and additionally for decreased wear on these elements of pocket 16 at scoop 12.

Figure 7A:
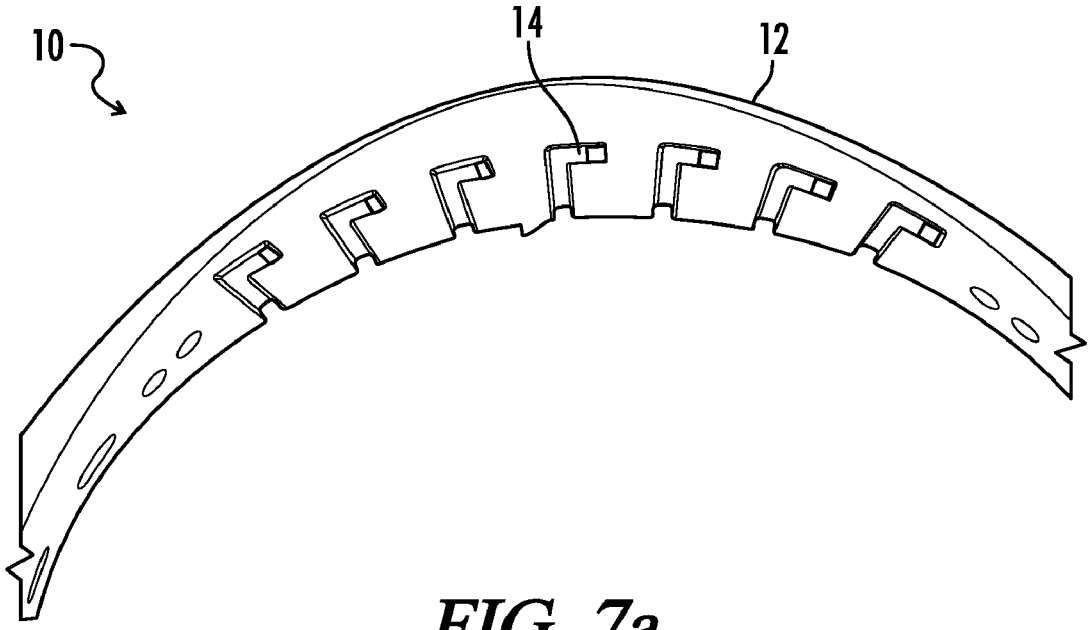
FIG. 7*a* is front view of an embodiment of the string channels in a strung lacrosse head.
Figure 7B:
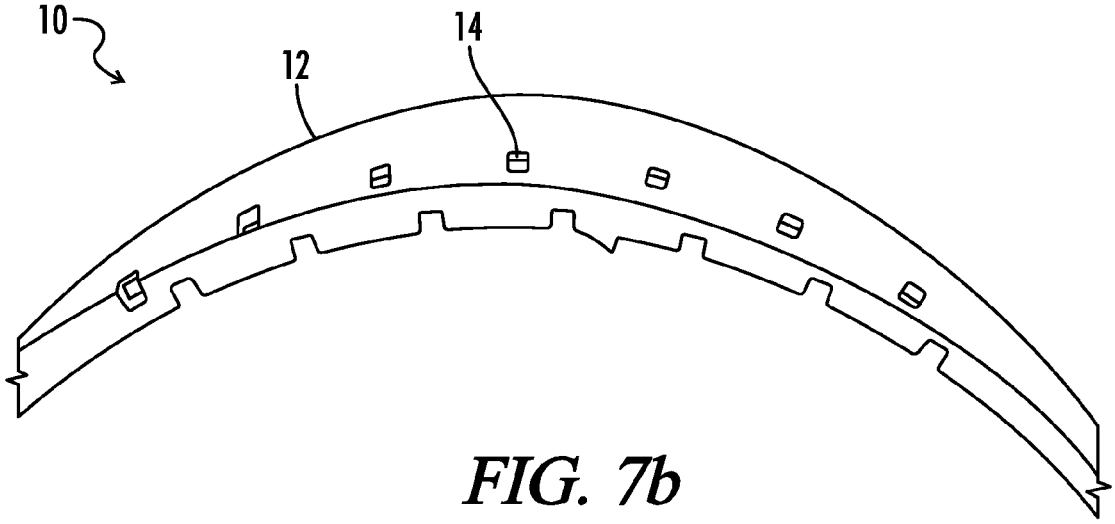
FIG. 7*b* is a rear view of an embodiment of the string channels in a strung lacrosse head.
Figure 7C:
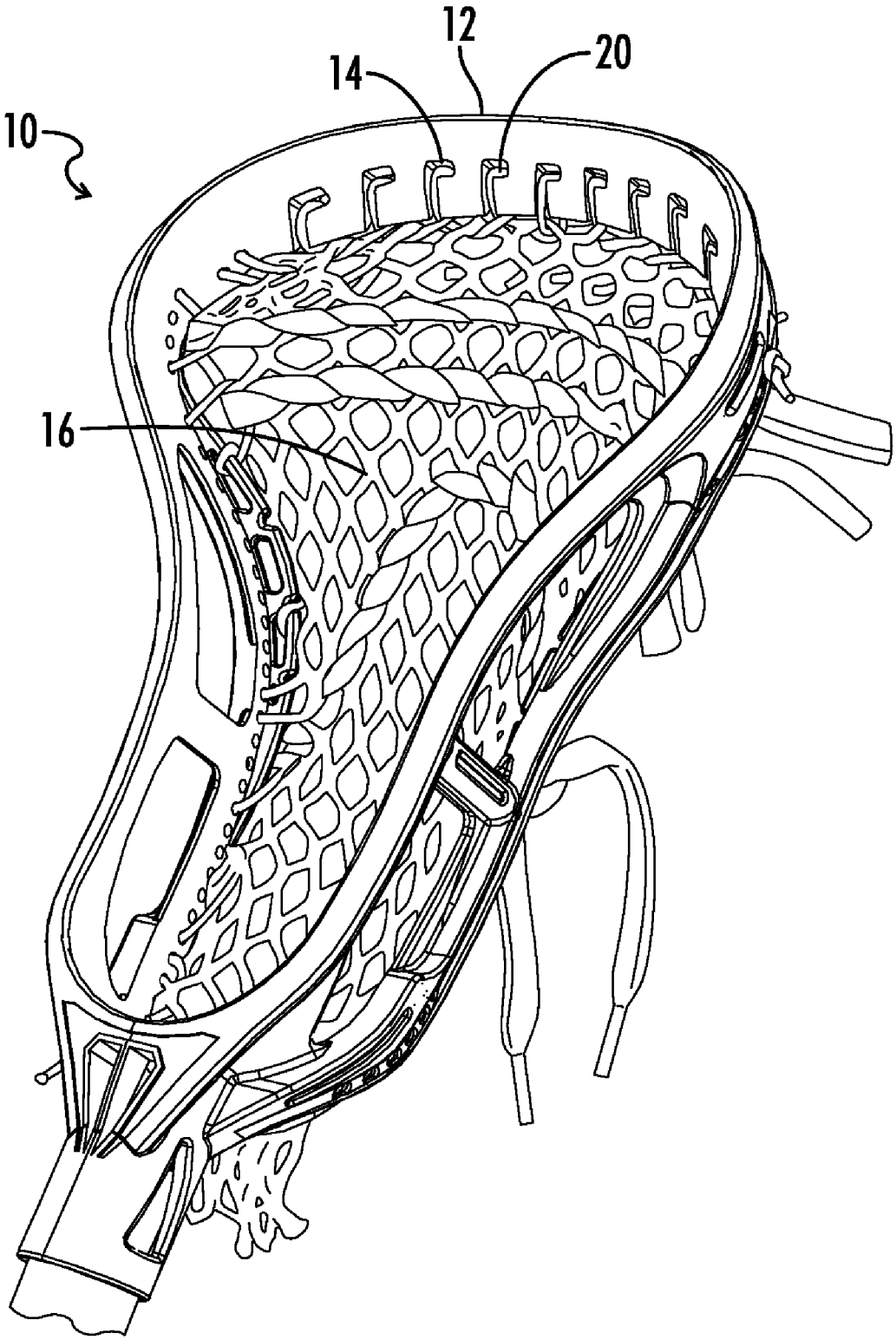
FIG. 7*c* is an illustration of an embodiment of the string channels in a strung lacrosse head.

FIG. 7*a* through 7*c* illustrate an additional embodiment of stringing channel 14 wherein typically runners are not utilized as pocket 16 is generally of a mesh configuration within lacrosse head 10. More specifically, string channels 14 have an L-shape configuration allowing for an easy stringing and improved ground ball pickup while also providing protection to lace 20 as it is at least partially recessed within scoop 12 of lacrosse head 10. Furthermore, the rear surface of scoop 12 as illustrated in FIG. 7*b* also includes recesses to at least partially recess stringing of a lacrosse pocket. Furthermore, as best illustrated in FIG. 7*c*, lace 20 is recessed while firmly attaching pocket 16 to scoop 12 of lacrosse head 10. This stringing channel arrangement provides for ease in stringing as well as a greater life span of the pocket as the at least partial recessing of lace 20 instills greater durability to the lace which attaches pocket 16 to scoop 12 of lacrosse head 10. The use of string channels 14 provides greater protection and ease also in ground ball pickup over lacrosse pockets integrated into heads of the prior art. Furthermore, a player may more simply weave a lacrosse pocket within a lacrosse head having the inventive string channels as excessive looping, knotting, or other prior art string connections to the scoop are not necessary.

Figure 8A:
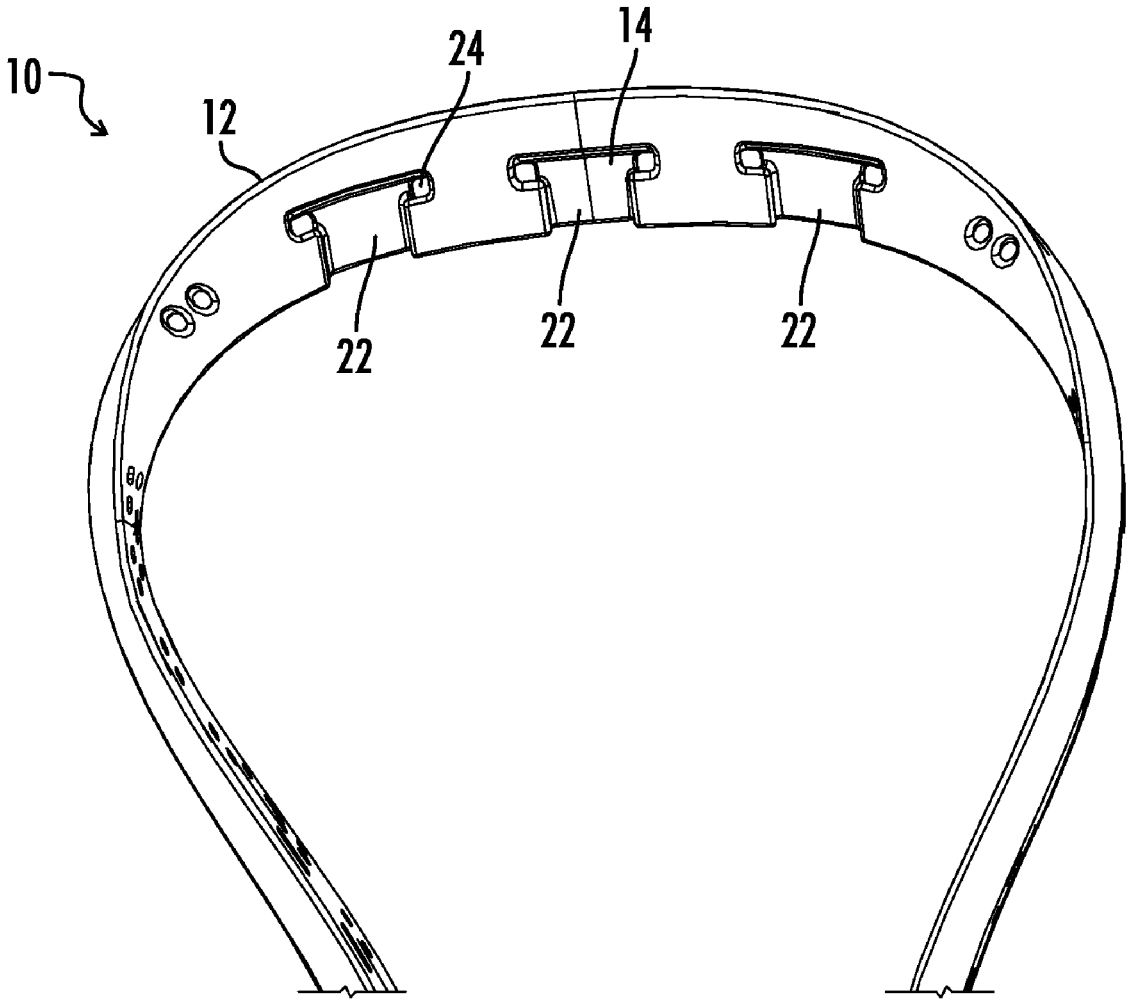
FIG. 8*a* is front view of an embodiment of the string channels in a strung lacrosse head.
Figure 8B:
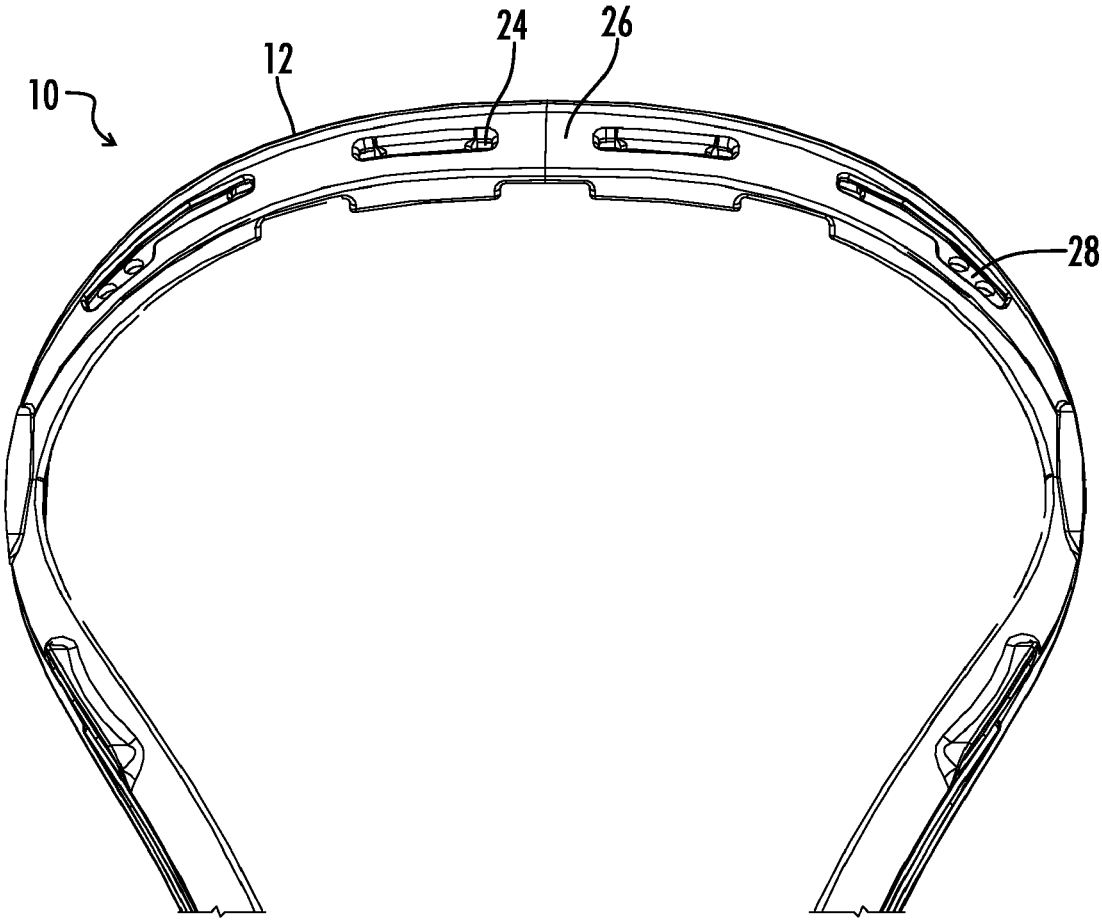
FIG. 8*b* is a rear view of an embodiment of the string channels in a strung lacrosse head.
Figure 8C:
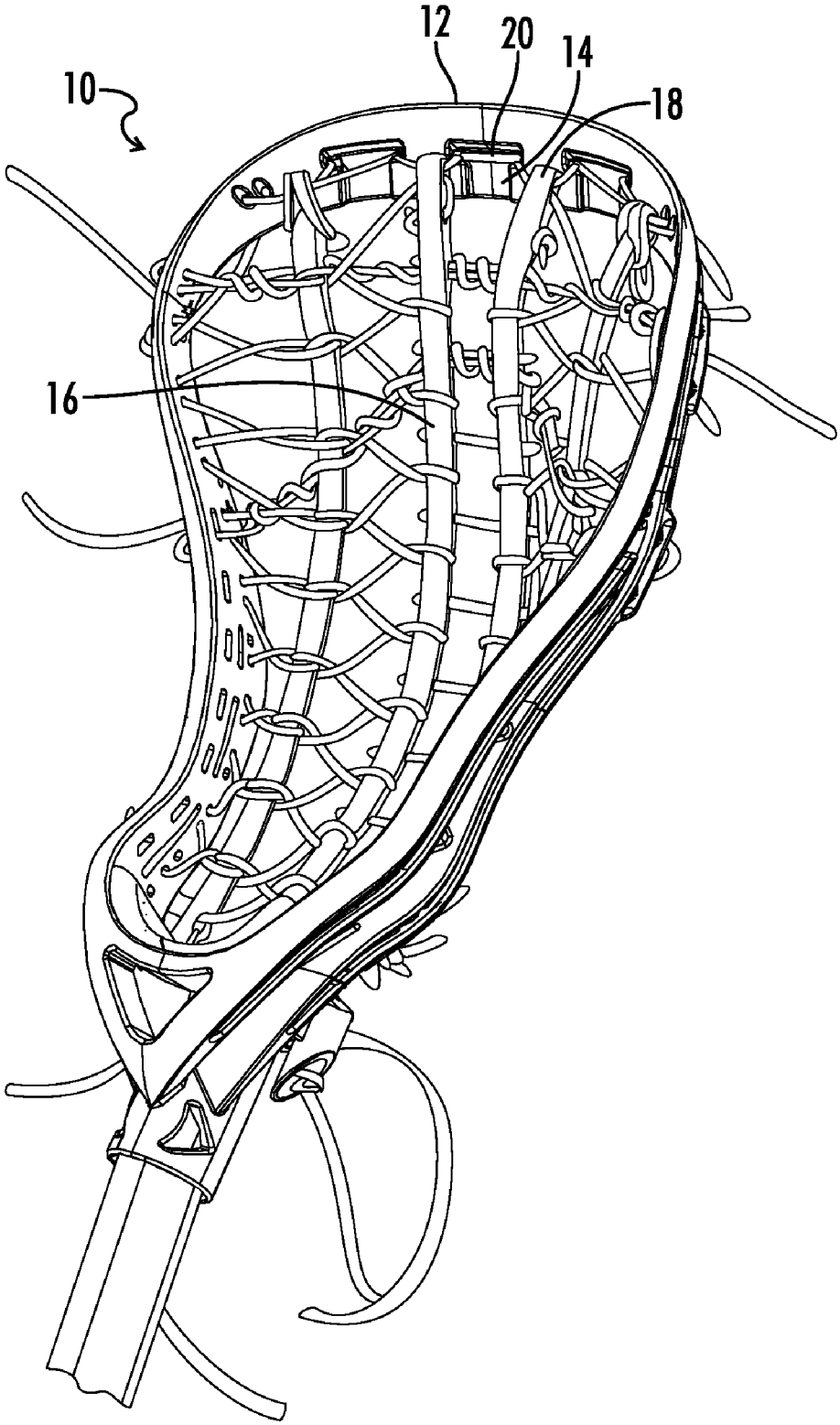
FIG. 8*c* is an illustration of an embodiment of the string channels in a strung lacrosse head.

FIG. 8*a* through 8*c* illustrate an additional embodiment of string channels 14 which may be utilized with different pocket types, including pocket design including types similar to FIG. 1 as well as FIG. 8*c* and further may be utilized with a variety of different pocket types. More specifically, stringing channel 14 may include a T-shaped recesses allowing for a variety of differently sized runners including wide runners as well as the use of multiple runners through each recess. In addition, as with other embodiments of the present invention, this embodiment may provide for easier stringing and improved ground ball pickup while also providing protection to laces and runners as they may be partially recessed within scoop 12 of lacrosse head 10.

The recessed channels of the present invention while embodying FIGS. 1-8*c* are not limited to the designs as illustrated. As such, recessed channels may take on a variety of configurations so long as at least the lace or runners are at least partially recessed within the scoop of the lacrosse stick.

Generally, the stringing channels of the present invent employ recesses of about the width of runners or wider, or may alternatively be sided to the stringing of a lacrosse pocket. Recesses may be on the front, the back, or on both sides of the scoop to provide the advantageous stringing channel. In some embodiments the recesses on the front and the back are oriented to provide protection to the stringing of the lacrosse pocket and furthermore, may allow for string to run through the channels about parallel with the scoop. The recesses on the front and the back may provide openings where the recesses overlap as illustrated in the above FIGS. 1-8*c*. In certain embodiments there may be two openings in each recess of the front of the lacrosse head as illustrated in the above lacrosse heads having T-shaped recesses on the front.

Accordingly, by the practice of the present invention, a lacrosse head with string channels having heretofore unrecognized characteristics is created. The string channels provide for greater durability of the lacrosse pocket as well as improved ground ball pickup as the runners and/or lace are at least partially recessed in the scoop of the lacrosse head.

The disclosure of all cited patents and publications referred to in this application are incorporated herein by reference.

The above description is intended to enable the person skilled in the art to practice the invention. It is not intended to detail all the possible variations and modification that are apparent to the skilled worker upon reading the description. It is intended, however, that all such modifications and variations be included within the scope of the invention that is defined by the following claims. The claims are intended to cover the indicated elements and steps that any arrangement or sequence that is effective to meet the objectives intended for the invention unless the context specifically indicate the contrary.

What is claimed is:

1. A lacrosse head with stringing channels comprising:

a frame with a scoop attached distally to two sidewalls, the scoop having a top edge and a bottom edge;

a throat attached proximally to the two sidewalls to create a pocket area with the frame and scoop having a front surface and a back surface; and stringing channels integrated into the scoop of the frame; each channel spanning from a location between the top edge of the front surface of the scoop and the bottom edge of the front surface of the scoop to the bottom edge of the front of the scoop;

lace holes connecting the channels for laces to fit within to maintain runners connected at the scoop of the lacrosse head wherein said channels comprise a shaped recess having an L-shape or a T-shape.

2. The lacrosse head of claim 1 further comprising a pocket with string within the pocket area of the lacrosse head.

3. The lacrosse head of claim 2 wherein string of the pocket engages the stringing channels integrated into the scoop of the frame.

4. The lacrosse head of claim 1 wherein the at least one stringing channel further comprises one or more recesses on the front of the scoop.

5. The lacrosse head of claim 2 wherein the recess comprises a shaped recess at least about the width of a runner for the pocket.

6. The lacrosse head of claim 1 wherein the at least one stringing channel further comprises one or more recesses on the back surface of the scoop.

7. The lacrosse head of claim 6 wherein at least one of the one or more recesses on the back of the scoop are oriented with at least one of the one or more recesses on the front of the scoop to provide an opening through the scoop.

8. A lacrosse head comprising:

a frame with a scoop attached distally to two sidewalls and a throat attached proximally to the two sidewalls to create a pocket area, with the scoop, sidewalls and throat having a front surface and a back surface;

stringing channels integrated into the scoop of the frame comprising one or more recesses on the front surface of the scoop with at least some of the recesses having a recess width sized about at least for a width of a runner for a lacrosse pocket;

each channel spanning from a location between the top edge of the front surface of the scoop and the bottom edge of the front surface of the scoop to the bottom edge of the front of the scoop;

lace holes connecting the channels for laces to fit within to maintain runners connected at the scoop of the lacrosse head wherein said channels comprise a shaped recess having an L-shape or a T-shape.

9. The lacrosse head of claim 8 further comprising a pocket strung within the stringing channels and in the pocket area.

10. The lacrosse head of claim 9 further comprising recesses on the back of the scoop for protecting stringing of the pocket.

11. A lacrosse head comprising:

a frame with a scoop attached distally to two sidewalls and a throat attached proximally to the two sidewalls to create a pocket area, with the scoop, sidewalls and throat having a front surface and a back surface, the scoop also having a top edge and a bottom edge;

stringing channels integrated into the scoop of the frame comprising recesses with at least some of the recesses having a recess width sized about at least a width of a runner for a lacrosse pocket on the front surface of the scoop and recesses on the back surface of the scoop, the recesses located between the top edge of the back surface of the scoop and the bottom edge of the back surface of the scoop and oriented about parallel with the bottom edge of the back surface of the scoop for receiving string of the lacrosse pocket and wherein said channels comprise a shaped recess having an L-shape or a T-shape and wherein a string is oriented about parallel to the scoop within the recesses for attaching the lacrosse pocket to the frame.

12. The lacrosse head of claim of claim 11 wherein the recesses oriented about parallel with the scoop comprise recesses on the back of the scoop.

13. A lacrosse head comprising:

a frame with a scoop attached distally to two sidewalls and a throat attached proximally to the two sidewalls to create a pocket area, with the scoop, sidewalls and throat having a front and a back;

stringing channels integrated into the scoop of the frame comprising recesses on the front surface of the scoop with at least some of the recesses having a recess width sized about at least the width of a runner for a lacrosse pocket; and recesses on the back surface of the scoop positioned to create openings within the scoop with the openings located in more than one of the recesses on the front of the scoop;

the recesses on the back surface of the scoop having different shapes then the recesses on the front surface of the scoop wherein said channels comprise a shaped recess having a T-shape and wherein a string is oriented about parallel to the scoop within the recesses for attaching the lacrosse pocket to the frame.

14. The lacrosse head of claim 13 comprising two openings located within each of at least one or more of the recesses on the front of the scoop.

15. The lacrosse head of claim 13 further comprising a lacrosse pocket with string within the recesses wherein the stringing channels protect the string.

* * * * *